United States Patent [19]

Smith et al.

[11] Patent Number: 4,729,301

[45] Date of Patent: Mar. 8, 1988

[54] HORIZONTAL BALING APPARATUS

[75] Inventors: Richard D. Smith, Richardson; John E. McDonough, Waco, both of Tex.

[73] Assignee: Mosley Machinery Co., Inc., Waco, Tex.

[21] Appl. No.: 802,866

[22] Filed: Nov. 27, 1985

[51] Int. Cl.[4] ..... B30B 15/30; B65B 57/10

[52] U.S. Cl. ..... 100/43; 100/3; 100/4; 100/45; 100/50; 100/215; 100/218; 100/232

[58] Field of Search ..... 100/3, 4, 7, 14, 42, 100/43, 44, 45, 48, 50, 215, 218, 232

[56] References Cited

U.S. PATENT DOCUMENTS

| | | | |
|---|---|---|---|
| Re. 26,315 | 12/1967 | Rhea . | |
| 2,938,451 | 5/1960 | Seltzer | 100/45 X |
| 3,225,683 | 12/1965 | Rhea . | |
| 3,386,370 | 6/1968 | Brown . | |
| 3,438,320 | 4/1969 | Raab | 100/43 |
| 3,501,890 | 3/1970 | Hunt . | |
| 3,576,161 | 4/1971 | Wright . | |
| 3,613,556 | 10/1971 | Wright et al. . | |
| 3,762,309 | 10/1973 | Wright et al. . | |
| 3,762,310 | 10/1973 | Wright . | |
| 3,828,663 | 8/1974 | Poplinski | 100/42 |

FOREIGN PATENT DOCUMENTS

| | | | |
|---|---|---|---|
| 2087791 | 6/1982 | United Kingdom | 100/45 |

*Primary Examiner*—Peter Feldman
*Attorney, Agent, or Firm*—Brumbaugh, Graves, Donohue & Raymond

[57] ABSTRACT

A horizontal baling apparatus having a compression ram which is provided so as to be reciprocally movable into the baling chamber of the apparatus, and a mechanism which scales the length of stroke of the compression ram to a total stroke of a potentiometer, from the output of which the density of a portion of a bale of material is determined as well as the necessary amount of additional material which is required on successive laminations to maintain the density.

13 Claims, 4 Drawing Figures

HORIZONTAL BALING APPARATUS

BACKGROUND OF THE INVENTION

The present invention relates to the field of processing compressible material such as scrap material, and more particularly, relates to an apparatus which forms bales of compressible material and subsequently straps the bale.

The use of baling apparatus is common in many industries to reduce a compressible material to compact bales for easy handling and storage. For example, balers can be used to bale virgin materials, solid waste, paper, aluminum cans and plastic to name a few applications. Large capacity baling apparatus capable of producing relatively large, high-density bales, are usually either of two types, vertical or horizontal. Vertical baling equipment employs a compression chamber through which a vertically moving ram or compression head is translated. Horizontal balers employ a horizontally moving compression ram. Certain balers in the prior art also employ an ejector ram which is transverse to the compression ram and ejects the bale when completed. It is this later type of baler to which the invention is directed.

Horizontal balers in the prior art are basically made of a hollow longitudinal body having a baling chamber, having dimensions approximately those of the finished bale, at one end thereof, and an elongated, open end, horizontal chamber into which the scrap material is introduced. A main ram is provided so as to reciprocate inside the hollow body to push the compressible material into the baling chamber. In many of these prior art balers, the main ram could extend only to the edge of the baling chamber. Balers of this type have the disadvantage that full compression of the material supplied does not occur until the baling chamber is completely filled and more material is forced into the chamber by the ram. To provide additional material the ram is pulled back from the baling chamber so as to allow additional material to fall into the baler.

As a result of the ram only extending to the edge of the baling chamber, and retracting to fully expose the inlet opening after each compression so as to allow a random quantity of material to be supplied, the balers in the prior art could not make bales of a uniform given density. Additionally, this prevented balers from achieving a high density bale. For example, for aluminum cans a density of 20–25 $lb/ft^3$ was the maximum attainable.

In some balers of the prior art, strapping means are provided so as to strap the completed bale as it is forced from the baler by the ejector ram. Various types of strapping devices are currently known in the art. However, many share the problem of not providing a simple means for indexing where the straps should be located on the bale. Many older devices can only locate the straps at fixed, predetermined locations, thereby not allowing for different strap configurations for different types of materials. Other devices in the art allow for indexing of strap location by use of a plurality of dogs located along the cylinder, which trigger a limit switch which causes a strap to form around the bale. The spacing of the straps is accomplished by physically moving the dogs to new locations. This has proved to be a difficult and time consuming task which results in a strapping means with less than ideal flexibility for various configurations of strap.

SUMMARY OF THE INVENTION

Accordingly, it is an object of the present invention to provide a baling apparatus which overcomes the deficiencies of the prior art and provides a bale of a given density.

It is a further object to provide improved indexing means for strapping the bale at desired positions.

Pursuant to these objects, and others which will become apparent hereafter, one aspect of the present invention resides in a horizontal baling apparatus having a body member defining a baling chamber at one end thereof, and having a hollow longitudinal section adjacent to the baling chamber, the hollow section having a material inlet therein; bale compression means including a compression ram provided in the hollow inlet section for reciprocal movement therein, so as to form laminations of the compressible material in the baling chamber; a drive cylinder for moving the ram; means for determining the density of the feed stock during compression of a lamination of the material on completion of a compression stroke; and means for calculating the amount of material required to be fed on successive compression strokes based on the determined density of feed stock, so that a desired number of additional laminations can be formed to complete a bale with a maximum uniform given density.

The novel features which are considered as characteristic for the invention are set forth in particular in the appended claims. The invention itself, however, both as to its construction and its method of operation, together with additional object and advantages thereof, will be best understood from the following description of specific embodiments when read in connection with the accompanying drawings.

DESCRIPTION OF THE PREFERRED EMBODIMENTS

Figure 1:
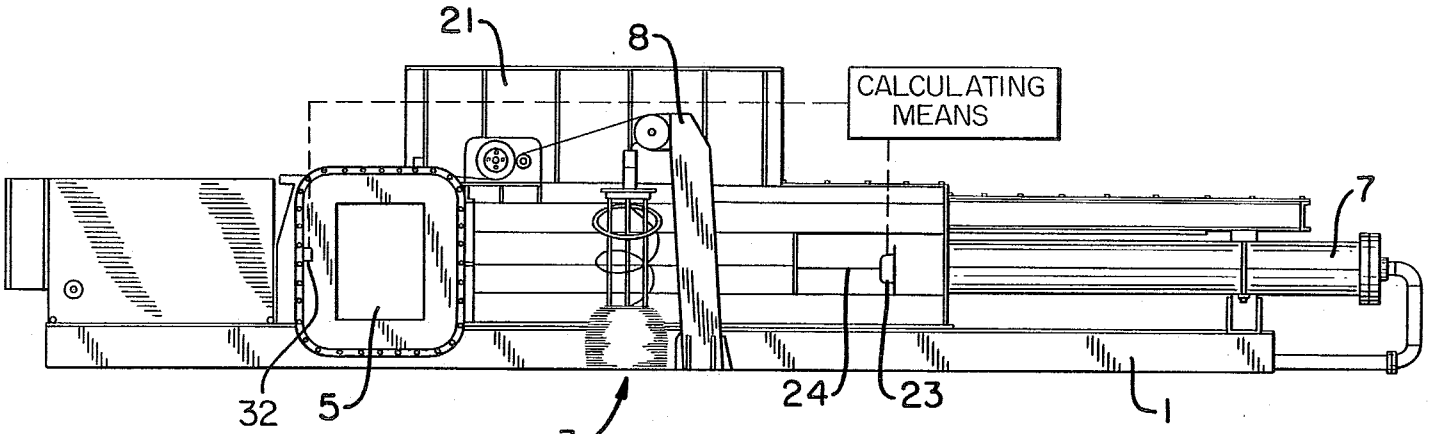
FIG. 1 is a side view of a baler pursuant to the present invention.
Figure 2:
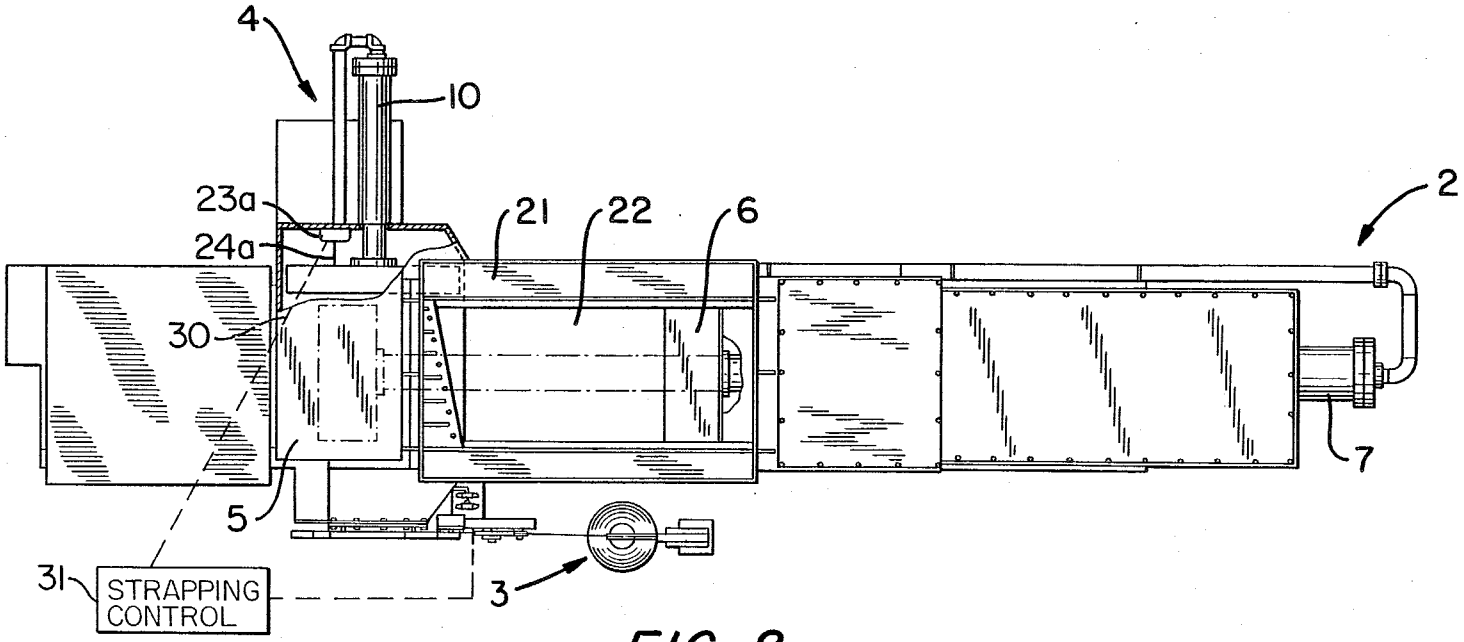
FIG. 2 is a top view of the baler in FIG. 1.
Figure 3:
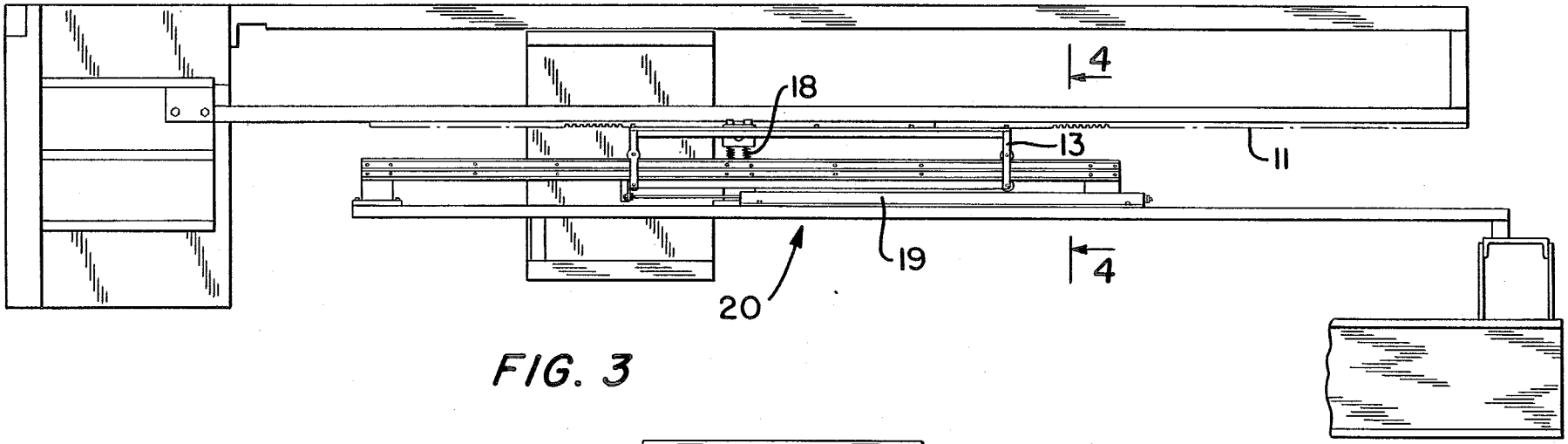
FIG. 3 is a partial, enlarged side view of the baler in FIG. 1, showing an embodiment of the ram position determining means.
Figure 4:
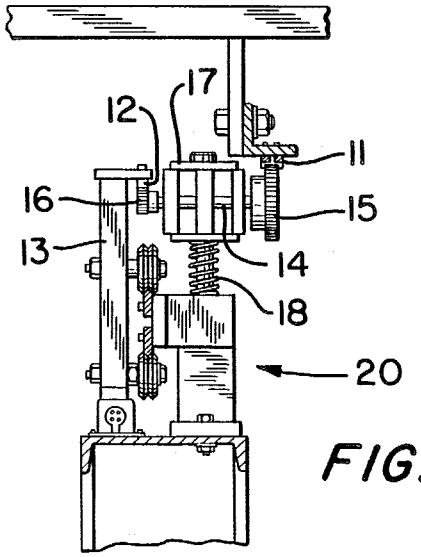
FIG. 4 is a cross-section along the lines 4—4 in FIG. 3, showing the ram position determining means.

Referring to the drawings in detail, the baling apparatus shown in FIGS. 1 and 2 is comprised of the following basic components: a body member 1, bale compression means 2, strapping means 3, bale ejecting means 4, means, generally indicated by the number 20, for determining the density of the compressible material supplied to the baler, and means (not shown) for calculating and supplying the additional amount of material required to be fed to the baler during successive compression strokes based upon the density determined during each compression stroke, so that a bale of a desired number of laminations can be formed. The calculating and supplying means includes devices generally known as programmable controllers, for calculating material required, and conventional conveyors, front end loaders, grapples, etc., for supplying the additional material.

The body member 1 defines a baling chamber 5 at one end thereof and a hollow longitudinal section 22 adjacent to the baling chamber 5, which is accessible through a material inlet opening 21.

The compression means 2 includes a compression ram 6 which is located within the hollow section 22 of the body member 1 and is moved reciprocally therein by a hydraulic drive cylinder 7. The compression ram 6 has a stroke which allows it to extend past the hollow portion of the body member 1 into the baling chamber 5 as shown by the broken line in FIG. 2.

The strapping means 3 is comprised of an automatic strapping mechanism 8 which is provided so as to strap the bale of material as it exits from the baling apparatus.

The ejecting means 4 includes an ejecting ram 9 and hydraulic drive cylinder 10 which are mounted orthogonally to the direction or movement of the compression ram 6 and serve to eject the compressed bale from the side of the body member 1.

The means 20 for determining the density of the material supplied includes conventional pressure sensing means 32, such as a pressure transducer, which senses the pressure exerted by the compression ram 6 on the scrap material as a lamination of the bale is formed, and means for measuring the travel of the ram 6 to a point where a maximum pre-selected compression is reached. The density of the material supplied can then be computed as a function of the output of the ram travel measuring means and the pressure exerted by the ram 6 as sensed by the sening means. This density computation then is used to control the means for supplying additional material so that a desired number of laminations are formed. In this way the supplying means provides the necessary amount of additional material for each lamination so that the bale is completed with the given density.

In one embodiment, the means for measuring travel of the ram 6 includes a commercially available string-type linear potentiometer 23,24. In such a potentiometer a string 24 of an appropriate material is drawn off of a drum to measure linear travel. In the present invention the string potentiometer 23,24 is connected to the compression ram 6 and is drawn off its drum as the ram 6 compresses the material thereby determining ram travel and allowing the density of the material to be computed by the density determining means 20, based on ram travel and pressure.

In another embodiment, the means for measuring ram 6 travel includes a first rack 11 fixed to the ram 6 so that it moves with it, and a second rack 12 mounted on a carrier 13 so that it is approximately parallel with the first rack 11. A pinion shaft 14 having a first gear 15 on one end thereof and a second gear 16 on the other end thereof, is provided in a gear box 17 so that each of the gears 15, 16 engages one of the racks 11, 12. The gear box 17 is supported by a spring 18 which allows the pinion shaft 14 to automatically adjust for height (up and down) and alignment (tilt) of the racks 11, 12, but has no movement in the plane of the cylinder stroke.

The second gear 16 engages the second rack 12 which is connected to a standard 48 inch linear potentiometer 19 by the carrier 13, and the size of the gears 15, 16 can be changed so that a necessary gear ratio is present for scaling the movement of the ram 6 to the 48 inch length of the potentiometer 19.

In either embodiment the above apparatus is rather simple in its operation and can be described generally as follows. The compression ram 6 is initially in its withdrawn position which is at a variable, preselected distance, e.g., 50%, 80% of 100% withdrawn, from the baling chamber 5. The material to be baled is then provided into the hollow section 22 of the body member 1 and the cylinder 7 is actuated so that the ram 6 compresses the material into a first lamination of a bale in the baling chamber 5. The linear string potentiometer 23,24, or pinion shaft assembly 14–18 translating the movement of the ram 6 to the potentiometer 19, allows the apparatus to know the position of ram 6. The movement of the potentiometer allows the density of the supplied material to be calculated based on how much of the initial opening produced how much of the partial bale. Based upon the density of the material determined, a supply means (not shown) provides additional material to the apparatus for successive laminations to complete the bale. This is then repeated for each lamination of the bale. With this type of baler it is possible to achieve denser bales than prior art devices. For example, the present invention can form a bale of aluminum cams with a density of over 30 $lb/ft^3$ compared to the 20–25 $lb/ft^3$ maximum density obtainable with prior art balers.

In yet another embodiment of the invention, the amount of movement of the ram 30 is determined by another linear string-type potentiometer 23A,24A. The output of this second potentiometer is input to a control means 31 which controls the strapping means 3 so that the bale is strapped in any desired sequence of positions. Such control means may be a conventional actuating device which is triggered when a specified potentiometer output is received, and subsequently actuates the strapping means 3.

While the invention has been illustrated and described as embodied in a pinion shaft assembly for a baler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapted it for various applications without omitting features that, from the standpoint of prior art, fairly constitute essential characteristics of the generic or specific aspects of this invention.

What is new and desired to be protected by letters patent is set forth in the appended claims.

We claim:

1. A horizontal apparatus for baling compressible material of unknown density, comprising:

a body member defining a baling chamber at one end thereof, and having a hollow longitudinal section adjacent to said baling chamber, said hollow section having a material inlet therein;

bale compression means including a compression ram provided in said hollow inlet section for reciprocal movement therein, so as to form laminations of the compressible material in said baling chamber;

a drive cylinder for moving said ram;

means for determining the density of the feed stock during compression of a lamination of the material on completion of a compression stroke; and means for calculating the amount of material required to be fed on successive compression strokes based on the determined density of feed stock, so that a desired number of additional laminations can be formed to complete a bale of desired density.

2. A baling apparatus as defined in claim 1, wherein said density determining means includes means for sensing the pressure exerted by said compression ram on the scrap material, and means for measuring the travel of said compression ram, the density of the feed stock being computed as a function of the distance travelled by said compression ram and the pressure exerted by said compression ram.

3. A baling apparatus as defined in claim 2, wherein said travel measuring means includes a potentiometer.

4. A baling apparatus as defined in claim 3, wherein said potentiometer is a string-type linear potentiometer.

5. A horizontal apparatus for baling compressible material, comprising:

a body member defining a baling chamber at one end thereof, and having a hollow longitudinal section adjacent to said baling chamber, said hollow section having a material inlet therein;

bale compression means including a compression ram provided in said hollow inlet section for reciprocal movement therein, so as to form laminations of the compressible material in said baling chamber;

a drive cylinder for moving said ram;

means for determining the density of the feed stock during compression of a lamination of the material on completion of a compression stroke, said density determining means including means for sensing the pressure exerted by said compression ram on the scrap material, and means for measuring the travel of said compression ram, the density of the feed stock being computed as a function of the distance travelled by said compression ram and the pressure exerted by said compression ram, said travel measuring means including a linear potentiometer having a stroke length, a first rack mounted on said cylinder so as to be movable therewith, a second rack provided on a carrier member so as to be approximately parallel with said first rack, said carrier member being connected to said potentiometer, and a pinion shaft having a gear on each end thereof, and being provided between said first and said second racks so that one of said gears engages with each of said racks, said gears having a variable gear ratio which allows the length of the cylinder stroke to be scaled to the stroke length of said potentiometer; and means for calculating the amount of material required to be fed on successive compression strokes based on the determined density of feed stock, so that a desired number of additional laminations can be formed to complete a bale.

6. A baling apparatus as defined in claim 1, wherein said compression ram is movable into said baling chamber.

7. A horizontal apparatus for baling compressible material, comprising:

a body member defining a baling chamber at one end thereof, and having a hollow longitudinal section adjacent to said baling chamber, said hollow section having a material inlet therein;

bale compression means including a compression ram provided in said hollow inlet section for reciprocal movement therein, so as to form laminations of the compressible material in said baling chamber;

a drive cylinder for moving said ram;

means for determining the density of the feed stock during compression of a lamination of the material on completion of a compression stroke;

means for calculating the amount of material required to be fed on successive compression strokes based on the determined density of feed stock, so that a desired number of additional laminations can be formed to complete a bale;

an ejecting ram provided orthogonally to the direction of movement of said compression ram so as to eject a compressed bale from said baling chamber;

an ejecting cylinder provided so as to drive said ejecting ram;

strapping means for strapping the compressed bale as it is ejected from said baling chamber;

means for determining the distance travelled by said ejecting ram; and means for activating said strapping means as a function of the distance travelled by said ejecting ram so that the compressed bale can be strapped at desired locations thereof, said means for determining ejecting ram travel including a second potentiometer.

8. An apparatus as defined in claim 7, wherein said first and said second potentiometer is a string-type linear potentiometer.

9. An apparatus as defined in claim 5, wherein said first and said second racks each have a width greater than said gears.

10. In a baling apparatus having a hollow body and a compression ram mounted therein for reciprocal movement for compressing a compressible material of unknown density, the improvement comprising:

means for measuring the distance travelled by the compression ram;

means for determining the density of the feed stock as a function of the length of compression ram travel during a compression; and means for calculating an appropriate amount of additional material to be provided to the baling apparatus on successive compressions to produce a bale of a desired number of laminations.

11. An improved baling apparatus as defined in claim 10, and further comprising means for sensing the pressure exerted by said compression ram on the material as a lamination is formed, said density determining means determining the density of the feed stock as a function of the length of compression ram travel and the pressure exerted by said compression ram.

12. An improved baling apparatus as defined in claim 10, wherein said measuring means includes a potentiometer.

13. An improved baling apparatus as defined in claim 12, wherein said potentiometer is a string-type linear potentiometer.

* * * * *